United States Patent [19]

Ristvedt et al.

[11] Patent Number: 4,681,128

[45] Date of Patent: Jul. 21, 1987

[54] COIN SORTER

[76] Inventors: Victor G. Ristvedt, Rte. 8, Box 8904; Mark E. Ristvedt, 1000 Woodland Ct., both of Manchester, Tenn. 37355

[21] Appl. No.: 877,205

[22] Filed: Jun. 23, 1986

[51] Int. Cl.[4] ..... G07D 3/16

[52] U.S. Cl. ..... 453/6; 453/32

[58] Field of Search ..... 133/3 R, 3 A, 3 C, 3 D, 133/3 G, 3 H, 8 R

[56] References Cited

U.S. PATENT DOCUMENTS

| | | | |
|---|---|---|---|
| 4,086,928 | 5/1978 | Ristvedt et al. | 133/3 A |
| 4,098,280 | 7/1978 | Ristvedt et al. | 133/3 A |
| 4,564,036 | 1/1986 | Ristvedt | 133/3 A |

FOREIGN PATENT DOCUMENTS

| | | | |
|---|---|---|---|
| 0149906 | 7/1985 | European Pat. Off. | 133/3 A |

*Primary Examiner*—F. J. Bartuska

*Attorney, Agent, or Firm*—C. A. Phillips

[57] ABSTRACT

A coin sorter in which a sorting head is positioned over a rotating pliable disc and wherein coins are sorted by the combination of an outwardly extending tapered edge and a series of pins generally positioned in an outwardly extending line spaced from the tapered edge. The spacing between the line of pins and tapered edge increases with outward dimension, whereby coins of different diameter are urged over the tapered edge by different pins at different positions. The coins are then captured between the head and pliable disc and rotated to exit positions which are unique for each coin about the outside of the sorting head.

5 Claims, 7 Drawing Figures

COIN SORTER

BACKGROUND OF THE INVENTION

1. Technical Field

This invention relates generally to coin handling equipment and particularly to a high-speed coin sorter.

2. Background Information

U.S. Pat. Nos. 4,086,928 and 4,098,280 illustrate coin sorters which employ annular sorting heads positioned over and adjacent to a rotating disc having a resilient surface. Coins are then introduced through a central opening in a sorting head. The undersides of the sorting heads of these patents are configured to effect a single file of coins which spirals outward to a discrete and constant radial position defined by an inner facing edge of a circular peripheral guide. Coins are then sorted as a function of the unique position of the inner edge of different diameter coins upon their reaching the periphery of the disc. In U.S. Pat. No. 4,086,928, this is accomplished by pressing the inner edge into the resilient surface, enabling the outer edge to rise and be hurled over the peripheral guide. In U.S. Pat. No. 4,098,280, the final act of sorting involves initially pressing a coin into the resilient surface and holding it at a radial position (with respect to the center of the rotating disc) without the peripheral guide and ejecting different size coins by radially variable slots in the sorting head which releases coins. In both instances, a constant outer radial position is used as a reference position for coins.

Pertinently, European patent application publication No. 0151776 discloses the employment of an opposite referencing of coins wherein the inner edges of coins are referenced at a radial position, and sorting is effected in terms of the position of the outer edge of different diameter coins at the periphery of the disc. While the sorters of the prior art are effective, they all suffer from the fact that their sorting surfaces consisting of lands and recesses are tremendously complex, and machining costs are quite substantial. Further, insofar as is known by the applicant, none have been adapted to provide precise accuracy in supplying a desired number of coins of a given denomination.

Accordingly, it is the object of this invention to provide a coin sorter having a sorting head which is greatly simplified and one wherein precise control is effected over a delivery of a selected number of coins of a given denomination.

SUMMARY OF THE INVENTION

In accordance with this invention, instead of guiding coins outward to a peripheral position of a sorting head wherein either the inner or outer edges of coins are referenced with respect to the center of a rotating resilient disc, the applicant has eliminated the employment of either step and, in fact, effected sorting without any diametric referencing of a coin with respect to the center of rotating disc carrier and prior to their reaching the periphery of the disc. Instead, sorting is effected by intercepting them as they travel outward along a tapered guide edge. Interception is effected by a selected obstruction of coin, the obstruction being at a point on a coin opposite to the point on the coin in engagement with the guide edge, with the result that the coin is forced under the guide edge. It is then radially captured and then rotated clear of the sorting head. By varying the position of an obstruction and its distance from the tapered edge, coins of different diameter are urged under the guide at different positions and thus may be rotated over different paths and to different exiting positions. In this manner, coins of different diameter are ejected at different locations about the sorter.

As a further feature of this invention, the obstructions are pivotally mounted and may be raised upon the occurrence of the passage of a selected number of coins. The result would be that, thereafter, the remaining coins in the sorter will follow the tapered edge to a discrete exit and thus not interefere with the selection process.

As still a further feature of this invention, the obstructions would be discretely insulated and used as coin count detectors.

DETAILED DESCRIPTION OF THE DRAWINGS

Figure 1:
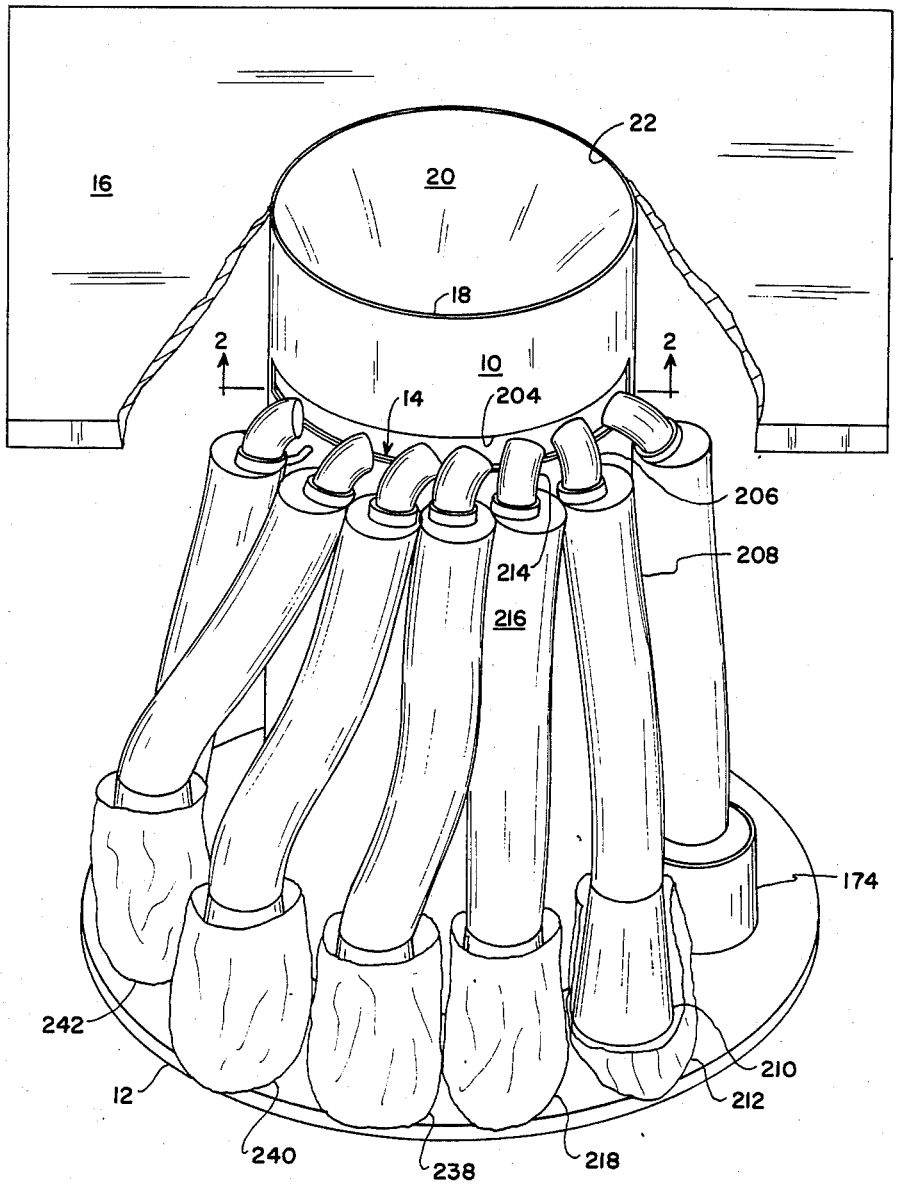
FIG. 1 is a pictorial view illustrating in general the configuration of the coin sorter of this invention.

Referring to the drawings, and initially to FIG. 1, a circular pedestal 10 supported by a base 12 houses a coin sorting apparatus 14. A table top 16 is supported at the top 18 of pedestal 10, and it provides a work surface upon which coins may be placed and inspected prior to being supplied sorting apparatus 14. Funnel-shaped hopper 20 extends from the periphery of opening 22 in table 16 through which coins from table 16 are actually supplied sorting apparatus 14.

Sorting apparatus 14 (FIG. 2) includes a base plate 24 which rests on pins 26 extending through wall 28 of pedestal 10. A motor 30 is attached to the bottom of base plate 24 (by means not shown). A drive wheel 32 on motor shaft 34 frictionally engages the edge 36 of turntable 38 to drive it. Turntable 38 is supported by bearing 40 and is mounted on a shaft 42 which in turn is supported by bushings 44 and 46 affixed in shaft recesses 48 and 50. Turntable 38 is driven at a selected speed, for example, 480 rpm, which generally provides a sorting speed of from 3,000 to 3,400 mixed coins per minutes. Turntable 38 has a generally flat upper surface 52 upon which is affixed a flexible, resilient pad 54.

Figure 2:
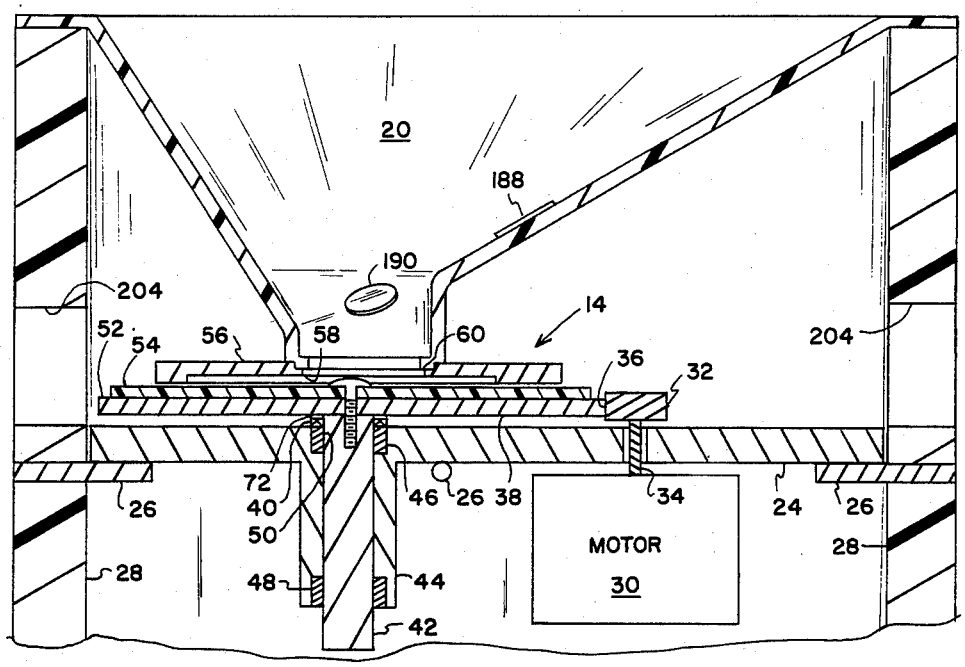
FIG. 2 is a sectional view taken along line 2—2 of FIG. 1.

Coin sorting head 56 has a central opening 58 about which is included a groove 60 (FIG. 2) into which is closely fitted the bottom of hopper 20. Head 58 is supported on one side by a groove 62 in mount 64 (FIG. 3), in turn supported on a base plate 24 by means not shown. A second mount 66 is positioned on an opposite side of sorting head 56. It, too, is attached to base plate 24 (by means not shown), sorting head 56 being coupled to mount 66 by a bolt 68 which has a tapered end 70 which enables sorting head 56 to be precisely horizontally mounted with respect to the perpendicular axis of shaft 42 (FIG. 2). The spacing between sorting head 56 and resilient pad 54 is adjustable by the insertion of selected washers as shims 72 (FIG. 2) on the top of bearing 46 where turntable 52 rests.

Figure 4:
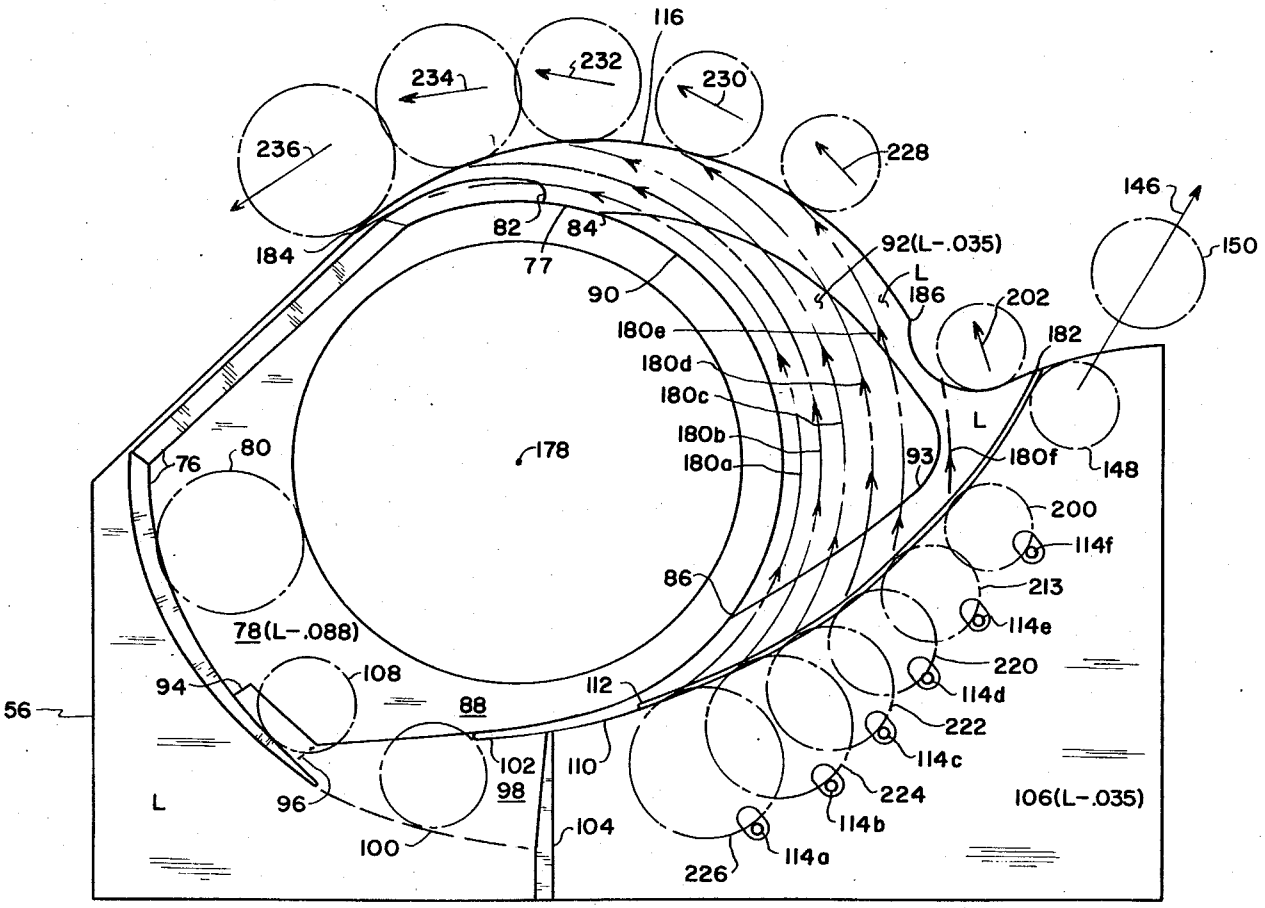
FIG. 4 is a planar view of the underside of the sorting head of the sorter and illustrating operation of the sorter.

FIG. 4 illustrates the underside of sorting head 56 which is configured with lands and recesses which control the sorting process. A basic or reference land L, while varying in edge configuration, is flat and is positioned with a slight clearance, 0.001 to 0.005 inch, above pad 54 (FIG. 2). It extends substantially around the central portion of sorting head 56 (FIG. 4) and provides a radial barrier against coins (shown in dotted line positions) attempting to move directly radially outward. Tapered edge 76 of edge 77 of land L extends to a recessed land 78, also marked L-.088 (indicative that it is recessed 0.088 inch from land L), and recessed land 78 forms a cavity within which coins are free to move radially outward to a position, as illustrated by coin 80. In addition to providing a radial stop, tapered edge 76 functions to prevent coin bounce and initially holds them in a radial position for further processing. The balance of inner edge 77 of land L, from point 82 to point 84 and from point 86 to point 88, is vertical and functions to simply block outward radial movement of coins. From point 84 to point 86, outward movement of coins from the central region of sorting head 56 is blocked by a vertical inner edge 90 of recessed land 92. Recessed land 92 is also designated as L-.035 as it is recessed 0.035 inch from the level of land L.

Tapered edge 76 of land L extends counterclockwise (in FIG. 4) to downwardly (as when head 56 faces downward in operation) extending ramp 94. Ramp 94 terminates at point 96 into a land region 98. Land region 98 of land L sloped upward (as when head 56 faces downward for operation) and inward from line 100 at an angle of approximately 1.5°, forming a transition slope which at point 102 has a recess elevation of 0.020 inch higher than land L. Region 98 of land L extends around to a transition edge of ramp 104, which ramp extends higher to land 106, also labeled L-.035. Land 106 is flat and at a level which is higher by 0.035 inch than land L. Coins, such as coins 108 and 100, initially process clockwise (counterclockwise as shown in down side up in FIG. 4) and then proceed under and down ramp 94, being captured by region 98 of land L. Then the coins would proceed up ramp 104 to land 106. They remain captured under land 106 although it is higher than land L is less than the thickness of the smallest coin being processed.

Rotation of a coin under land 106 is limited, first by abrupt edge 110 and then by tapered edge 112, the latter being tapered approximately 35° from the vertical. Abrupt edge 110 is positioned such that larger coins strike it and thus move around and along it before reaching tapered edge 112, whereas smaller coins are simply rotated against tapered edge 112. Thereafter, all coins are initially moved outward along tapered edge 112 by rotating pad 54.

In accordance with this invention, sorting is effected by the distance between tapered edge 112 and a particular pin of pins 114*a*–114*f*. The distance between a pin and tapered edge 112 is preset to urge a particular diameter coin under and across tapered edge 112 under the force of rotating pad 54. As will be noted, the first pin-edge combination distance is the greatest, the second pin-edge combination distance being less, and so on until the distance between a pin and edge 112 is the least. In each instance, the distance is such to urge a coin downward under tapered edge 112. Once this occurs, a coin is compressed or captured between land L and pad 54, and its movement is circular. A coin continues its rotation until rotation carries it from under land L, at which point it is free to move outward from edge 116. At this point, means are provided, as will be further explained, to intercept coins and direct them into a bag or other receptacle, this being at a unique position around head 56. By the combination of the relationship of pins 114*a*–114*f* to edge 112 and the change in radius of the outer edge 116 of land L with a circumferential position, exit points around head 56 are chosen which enable relatively even distribution or spacing of exits.

Figure 5:
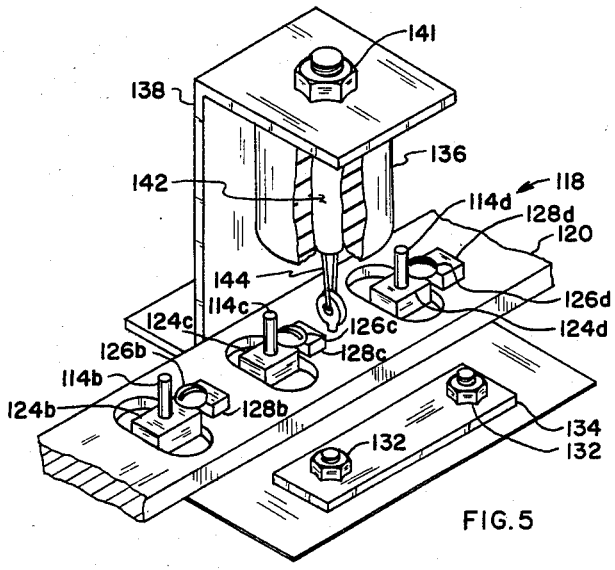
FIG. 5 is a detail of construction in the form of a pictorial view, this view being of a portion of a sorting pin assembly.
Figure 3:
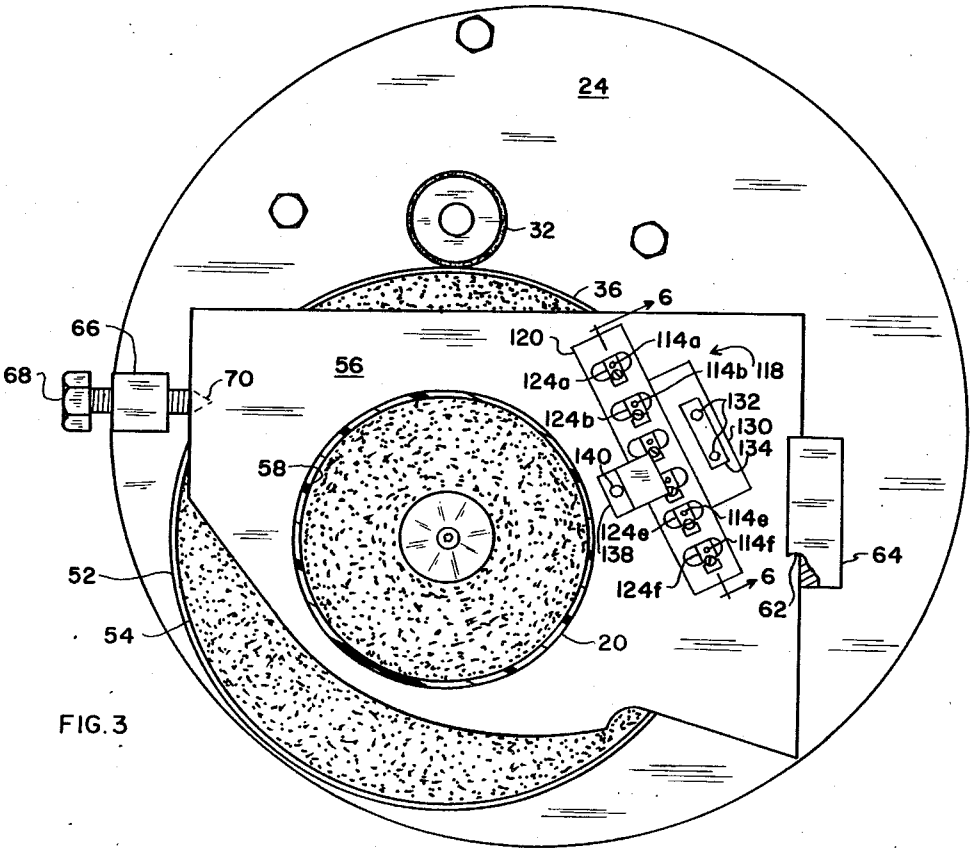
FIG. 3 is a top view of the sorting head of the sorter and support.
Figure 6:
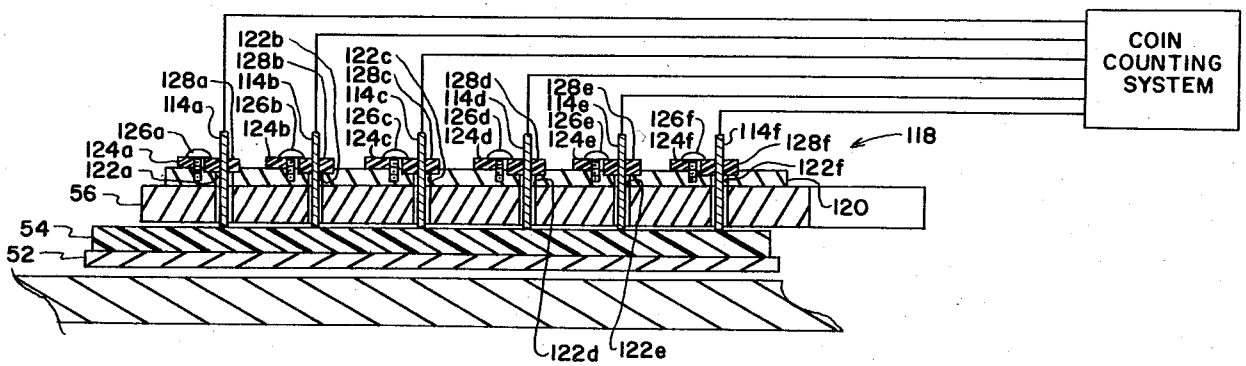
FIG. 6 is a view, partially sectional and partially schematic, illustration the construction of the sorting pin assembly and its electrical connection to a coin counting system.

FIGS. 3, 5, and 6 illustrate the construction of pin assembly 118. Pin assembly 118 includes a rectangular plate 120 having a plurality of openings 122*a*–122*f*. Pins 114*a*–114*f* are mounted in discrete insulating blocks 124*a*–124*f*, and the insulating blocks are mounted over openings 122*a*–122*f*. Bolts 126*a*–126*f*, in conjunction with shoulder insulating blocks 128*a*–128*f*, hold blocks 124*a*–124*f* and thus pins 114*a*–114*f* in place as shown in FIG. 6. Pins 114*a*–114*f* normally extend below the lower surface of land 106 and approach the surface of pad 54, being spaced approximately 0.001 inch from pad 54. Plate 120, on which the pin assemblies are mounted, is attached (by means not shown) to spring steel member 130, which in turn is attached by attachment bolts 132 and plate 134 to head 56. By this arrangement, plate 120 and thus pins 114*a*–114*f* may be raised and lowered by the hinge action of spring steel member 130. Normally, spring steel member 130 biases plate 120 and thus pins 114*a*–114*f* to a lowered position as described for operation. Plate 120 and pins 114*a*–114*f* are selectively raised by solenoid 136 which is mounted on a mounting bracket 138 by nut 141, and bracket 138 is attached by bolt 140 to head 56. Solenoid 136 includes a plunger 142 which is coupled by link 144 to plate 120. When power is applied to solenoid 136, plunger 142 is retracted, pulling plate 120 and thus pins 114*a*–114*f* upward to a raised position above pad 54. When they are raised, the sorting process halts, and coins remaining in the sorter exit along the line of arrow 146 and as illustrated by coins 148 and 150 in FIG. 4.

Figure 7:
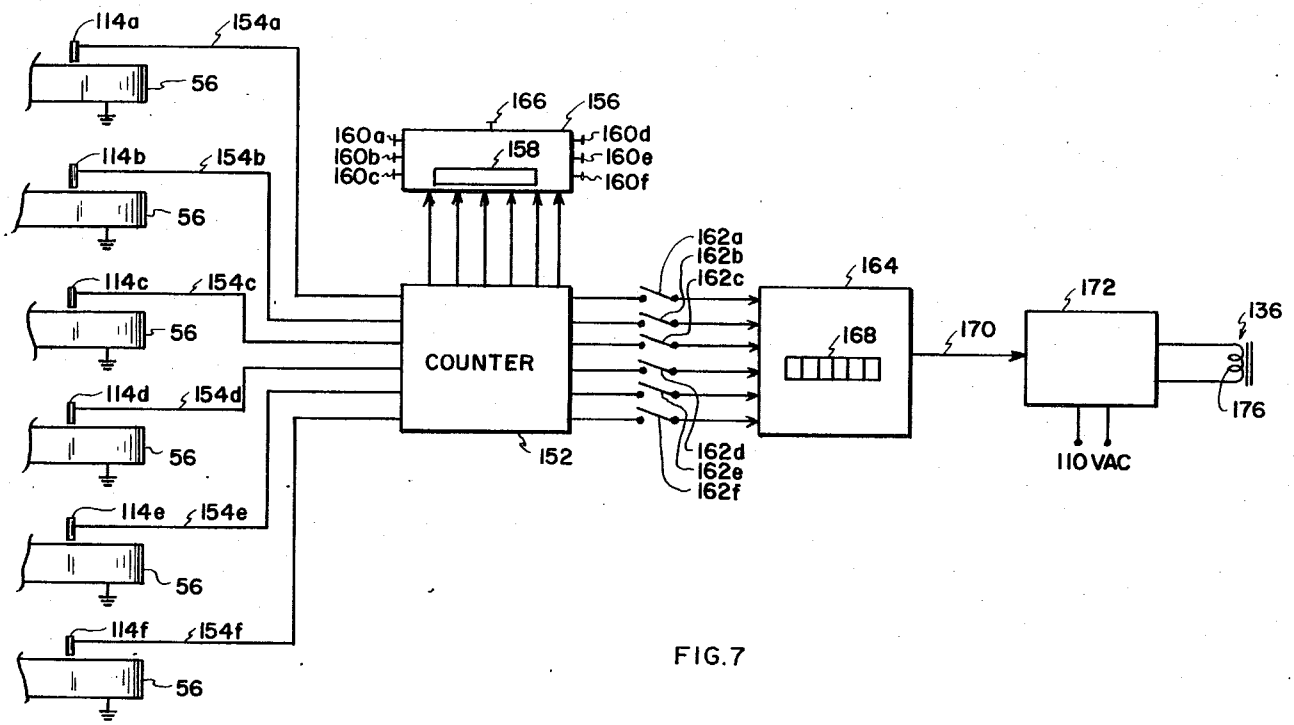
FIG. 7 is an electrical block diagram illustrating a coin counting system as contemplated by the invention.

FIGS. 6 and 7 illustrate the electrical connection of pins 114*a*–114*f* to coin counter 152. Coin counter 152 is of a conventional type for counting events, and in this case, each instance of the encounter of a given diameter of coin with a discrete pin. When this occurs, a closed electrical circuit is effected between a pin and head 56. This closed circuit is applied to coin counter 152 via one of end leads 154*a*–154*f* and a common ground connection between the sorter head and coin counter 152. Thus, with this configuration, coin counter 152 senses an electrical impulse each time that a coin strikes an associated pin, and thus, coin counter 152 is configured to separately count each denomination of coin. It then provides a count for each denomination of coin to coin count storage and totalizer 156 which multiplies each count of each denomination by the denominational value of a coin and then makes available at readout 158 a total dollar amount of a particular coin and the total dollar amount of all coins counted. Additionally, totalizer 156 includes cnventional circuitry for displaying on readout 158 a coin count for each coin. A selection of either a total value or a discrete coin count is provided by control buttons 160*a*–160*f*.

There is illustrated as a separate set of outputs of coin counter 152 discrete coin outputs for each denomination counted which are supplied through selector switches 162*a*–162*f* to count select 164. Count select 164 is basically a digital comparator wherein one would enter into count select 164 a selected number representative of the number of a given denomination of coin that is desired as an output from a sorting function. Thus, if it were desired to stop the sorting process when there were 1,000 dimes processed through the sorter, 1,000 would be entered in count select 164, as by toggling a decade select button 166 to enter a number for each decade. This number would then be entered in memory and displayed by readout 168. When the selected count occurs from the operation of the sorter, there would be parity or identity between an output of coin counter 152 of such a count which would be compared by count select 164 to produce an electrical output on lead 170 which would operate power source 172 to cause solenoid 136 to be operated, causing plate 120 to be pulled upward, raising all pins upward and thus enabling all coins thereafter to go into overflow receptacle 174 (FIG. 1). The cutoff would thus have effected the delivery of 1,000 coins to the selected exit for that coin. Power source 172 may simply be a relay having a 110-volt input as shown, which is operated closed upon the receipt of an input signal from count select 164 to then cause 110-volt A.C. to be applied to coil 176 of solenoid 136. Alternately, power source 110 would include a double throw relay which would provide for a higher voltage to be initially impressed upon solenoid 136 to effect quick closing and then a lower voltage to be applied as a holding voltage.

Sorting of mixed coins is accomplished by the combination of the relationship between the position of pins 114*a*–114*f* when in the lowered position and tapered edge 112 which is tapered at an angle of 35°, and edge 112 generally extends outward with circumferential position measured in a counterclockwise direction in FIG. 4, such as shown, the distance between a pin and tapered edge decreasing with radial distance. As a result, coins are captured at a radial distance from center point 178 which is inversely proportional to the diameter of the coin. The configuration of land L is such that some portion of land L always presses on and retains the capture of a coin at a discrete radial position as coins are rotated in the direction of arrows 180*a*–180*f* until they pass over outer edge 116 of land L, which occurs in the region between point 182 and point 184. Edge 116 is turned inward from point 182 and then generally circles outward to point 186, where the arc of the edge reverses, then follows a circular arc of a constant radius until it reaches point 184. With this configuration together with the capture of each different denomination of coin at a different radial position, each coin is released by land L at a different circumferential position as illustrated in FIG. 4. In the event that pins are retracted, which is effected when there has occurred a selected count of a given one of the coins, all of the coins will move along edge 112 until they exit in the direction of arrow 146. They would then be all caught in overflow receptacle 174.

To examine operation of the sorter, motor 30 would be turned on, causing turntable 52 and pad 54 to rotate in a clockwise direction, considering that the sorting head as illustrated in FIG. 4 would be facing downward. Coins of different denomination, for example, half dollars, Susan B. Anthony dollars, quarters, nickles, pennies and dimes (U.S. denominations), would be mixed and emptied into hopper 20 (FIGS. 1 and 2) which would then funnel coins onto the center region of pad 54 as illustrated by coins 188 and 190 of FIG. 2. Coins are then urged under recess 78 by centrifugal force from pad 54 (e.g., coin 80) and travel circularly until they are generally aligned in a single file along edge 76 of land L. Then they ride under ramp 94 (coin 108) where coins are pressed down into resilient pad 54 and are thus captured and are moved in a circular direction with respect to center point 178. Large coins such as 80 and 110 would initially be moved against edge 102, typically at point 88, and are thus held to the outside of edge 88. Thereafter, they would be rotated or they would simply engage tapered edge 112. As shown in FIG. 4, coins move along edge 112 until a coin strikes one of the series of pins 114*a*–114*f*. As will be noted, when this occurs, a coin is urged under the 35° slope of edge 112 and is then captured by land L and rotated circularly. While an inner edge 98 of land L extends outward and then curves inward, the configuration of land L is such that all coins after being captured are captured at least by some area of engagement with land L as they move circularly until they are freed from capture by outer edge 116 of land L. The region 92 interior of edge 93, being at a height of 0.035 inch above reference land L, traps any coins which are not properly riding along the interior side of edge 90, this being particularly the case with coins which are doubled, wherein a coin, particularly a small coin such as a dime, may ride below and under another coin with the result that it passes under land 92 and into region 92. In this case, the coin is captured (coins being of greater thickness than the clearance between land L and pad 54) and rotated against edge 90 and then moved back into the center region of pad 54. Thereafter, the coin would move outward, as in the case of the original coins, for sorting as described above.

Following coin discrimination as described above, the smallest coin 200, e.g., a dime, following the direction of arrow 202, would move through slot 204 (FIG. 1) and then through L-shaped fitting 206, then through tube 208 through bag funnel 210, and then into a bag 212. In the same manner, the next largest coin, for example, a penny 213, would be moved outward through slot 204 downward through fitting 214, tube 216 and into a bag 218. In the same manner, the next larger coins, coins 220, 222 224, and 226 (for example, a nickel, quarter, Susan B. Anthony dollar, and half dollar) would move in the direction of arrows 228, 230, 232, 234, and 236 and then through like discrete passageway elements into bags 238, 240, and 242.

Where it is desired to deposit only a selected number of coins of a particular denomination in a bag, a switch of switches 162*a*–162*f* for that denomination would be closed (FIG. 7). Then, a button, not shown, would be toggled until a desired number is entered into comparator 164 which would be indicated by display 168. Then, mixed or only coins of that denomination would be fed into the sorter and operation would proceed until count select senses that the desired number of coins of a selected denomination have passed into a container for that denomination. This is accomplished, of course, by continuity sensing between a pin of pins 114*a*–114*f* sorting head 56 supplied as an input electrical condition to the input of coin counter 152. Upon reaching the selected count, count select 168 sends a signal to power source 172 which operates to supply power to solenoid 136 and instantly pins 114*a*–114*f* are raised, preventing any other coins from being sorted, and any residual coins are passed in the direction of arrow 146 into overflow receptacle 174.

From the foregoing, it is to be appreciated that the applicant has provided a new and simplified coin sorter and one which readily enables a precise selection of a given denomination of coin.

We claim:

1. A coin sorter for mixing denominations of coins, coins of a different diameter, comprising:

a rotatable resilient disc;

means for rotating said disc;

a stationary sorter plate spaced from said disc, said sorter plate having a central opening through which coins may be placed on said disc, said sorter plate being characterized by:

a first surface closer to said disc than the thickness of the thinnest coin to be sorted, second surfaces less close to said disc than said first surfaces, a first guide edge formed at a junction region between said first surface and a said second surface comprising a first inwardly facing edge against which a sequential line of coins is formable, and a second guide edge at a second juntion region between a said first surface and a said second surface comprising a second, and tapered, edge formed circumferentially beyond said first guide edge, in the direction of rotation of said disc, and said second guide edge extending outwardly, coins being rotated by said disc under a said second surface region to said second guide edge and then being moved outward along said second guide edge as a result of the rotation of said disc; and sorting means for engaging coins riding along said second guide edge and pressing a discrete diameter of coin against said second guide edge, and by virtue of said taper of said second edge, causing said last-named coin to ride under said second guide edge and being engaged by a said first surface region and rotated under a said first surface region, and said last-named first surface region having an outer edge which is positioned to be intercepted by coins rotated under said first surface from said second edge at a discrete location for each diameter of coin;

whereby coins of a discrete size are released from said sorter at different positions around said sorter.

2. A coin sorter as set forth in claim 1 wherein said sorting means comprises a series of pins, each at a differnt spacing from said second edge, and said pins being positionable adjacent said disc.

3. A coin sorter as set forth in claim 2 further comprising counting means in turn comprising electrical means coupled to each said pin for counting coins engaging said pins.

4. A coin sorter as set forth in claim 1 wherein said sorting means for engaging coins comprises means for first engaging the largest coin to be sorted and last engaging the smallest coin to be sorted.

5. A coin sorter as set forth in claim 3 wherein:

said counting means includes means for providing a signal responsive to a selected number of at least one selected denomination having been counted; and pin positioning means responsive to said signal for increasing the spacing of said pins from said disc, whereby, thereafter, coins would exit from under said plate along a direction generally determined by the direction of said second edge.

* * * * *